US006004426A

United States Patent [19]

Johnson

[11] Patent Number: 6,004,426

[45] Date of Patent: Dec. 21, 1999

[54] CARPET STRIPPING APPARATUS AND METHOD

[75] Inventor: Will O. Johnson, Houston, Tex.

[73] Assignee: Akard & Griffin, Houston, Tex.

[21] Appl. No.: 09/002,523

[22] Filed: Jan. 2, 1998

[51] Int. Cl.[6] ..... B32B 35/00

[52] U.S. Cl. ..... 156/344; 156/584; 254/203; 254/213; 254/262; 254/202

[58] Field of Search ..... 156/344, 584; 254/199, 200, 202, 203, 208, 211, 213, 219, 242, 262; 294/8.6, 902; 269/53, 54.5

[56] References Cited

U.S. PATENT DOCUMENTS

| | | | |
|---|---|---|---|
| 4,332,371 | 6/1982 | Bell et al. . | |
| 4,394,052 | 6/1983 | Adams et al. . | |
| 4,560,146 | 12/1985 | Thomas et al. . | |
| 4,906,323 | 3/1990 | Thomas . | |
| 4,948,451 | 8/1990 | Foltz | 156/344 |
| 5,387,308 | 2/1995 | Heavrin . | |
| 5,454,899 | 10/1995 | Glenn et al. . | |
| 5,456,794 | 10/1995 | Barrett . | |

FOREIGN PATENT DOCUMENTS

| | | | |
|---|---|---|---|
| 3002831 | 7/1981 | Germany | 156/584 |

*Primary Examiner*—Mark A. Osele
*Attorney, Agent, or Firm*—Jeffrey E. Griffin

[57] ABSTRACT

A carpet removal apparatus for removing carpet adhered to a floor provides a spool having an attachment member adapted to attach a portion of a carpet to be removed to the spool member. The spool member is rotated over the upper surface of the carpet about the axis of the spool member to wind the carpet onto the spool member and tear the carpet from the floor. The spool member is typically rotated using a motor supported by a frame rotatably attached to the spool member. A power transmission member transmits the power and rotation from the motor to the spool member, slowing the rotation and increasing the power. An alternative, manual spool member uses a pair of rotating handles, one attached to each end of the spool member. The rotating handles are used as levers to force the rotation of the spool member and, thereby, wind the carpet onto the spool member, ripping the carpet from the floor.

11 Claims, 2 Drawing Sheets

CARPET STRIPPING APPARATUS AND METHOD

BACKGROUND OF THE INVENTION

1. Field of Invention

The present invention relates to the field of carpet removal. More specifically, the invention relates to a carpet stripping device that uses a lower power motor to rotate a carpet spool and, thereby, strip the carpet from the floor.

2. Related Art

Carpet is often adhered to a floor using an relatively strong adhesive. When the carpet wears, it must be removed and replaced. However, removing the carpet glued to the floor can be quite difficult. Typically, the carpet is removed by hand by simply pulling the edges of the carpet, ripping the carpet from the floor. Pulling the carpet from the floor can require a number of workers, pulling in unison to remove the carpet. The adhesive is sometimes strong enough that pieces of the concrete floor is ripped up with the adhesive and the carpet during the carpet removal. Thus, removing the carpet in this manner is labor intensive, costly, and time consuming.

A number of devices have been developed to remove carpet glued to a floor. Most of these devices use some sort of pulling device wherein one end is clamped to the edge of the carpet and the opposite end of the device is anchored. A motor then pulls the first end of the carpet toward the anchored second end ripping the carpet from the floor. Typically, these devices do not provide a means for neatly cutting the carpet to a width that can be easily handled.

Another prior effort uses a blade that scrapes below the carpet while an elevated, motorized spool rolls the carpet thereon. Although this device provides a way to neatly cut the carpet into strips, the device appears to be relatively complicated and, thus, relatively costly.

Thus, despite the use of the prior art features, there remains a need for a relatively inexpensive carpet stripping device that is easy to use and reduces or eliminates the manual labor associated with carpet stripping.

SUMMARY OF THE INVENTION

Accordingly, the objectives of the present invention are to provide, inter alia, a Carpet Stripping Apparatus and Method that:

- strips carpet from a floor;
- tears the carpet into strips that are conveniently disposed of;
- provides for easy attachment of the carpet to and removal of the carpet from the device;
- uses a convenient power source;
- reduces the time and cost required to remove carpet adhered to a floor;
- is low in cost and easy to implement;

Other objects of the invention will become apparent from time to time throughout the specification and claims as hereinafter related.

To achieve such improvements, the present invention generally provides a carpet removal apparatus for removing carpet adhered to a floor by an adhesive that uses a cylindrical spool member to which a free edge of the carpet is attached. The spool member is then rotated about its axis over the upper surface of the carpet winding the carpet onto the spool member and tearing the carpet from the floor.

One aspect of the invention provides a carpet removal apparatus for removing a carpet adhered to a floor from the floor, the carpet having edges and an upper surface. The carpet removal apparatus provides a cylindrical spool member having an axis and opposing ends, means for attaching an edge of the carpet to the spool member, and means for rotating the spool member about its axis over the upper surface of the carpet so that, as the spool member rotates, the carpet is torn from the floor and wound onto the spool member. The spool member is elongated. Preferably, the means for attaching the edge of the carpet to the spool member is a plurality of tooth members extending outwardly from the spool member that are laterally aligned between the ends of the spool member to form a row of tooth members. The tooth members may extend radially from the spool member or at some other angle relative thereto. Also, the carpet removal apparatus may include a plurality of rows of tooth members.

In the preferred embodiment, the means for rotating the spool member is an actuating member attached to the spool member. In one possible aspect of the invention, the actuating member provides a frame rotatably attached to the opposing ends of the spool member, so that the spool member may rotate relative to the frame. A motor is attached to the frame. A power transmission member communicating with the motor and the spool member transmits the rotation and power from the motor to the spool member so that the motor rotates the spool member. The motor may be an electric motor, a gasoline powered motor, a hydraulic motor, or another type of motor. Typically, the power transmission member is a speed reducer.

In one alternative embodiment, the spool member is removable from the frame and the carpet removal apparatus includes a release mechanism adapted to selectively release the spool from and attach the spool to the frame.

In another possible aspect of the invention, the means for rotating the spool member is a manual apparatus that provides at least one rotating handle attached to the spool member. Preferably, the carpet removal apparatus includes two rotating handles, one rotating handle attached to each of the opposing ends of the spool member. The rotating handles are attached in such a way to permit the user or users to manually turn the spool member.

Another aspect of the invention provides a carpet removal apparatus that provides a cylindrical spool member rotatable about an axis, an attachment member attached to and extending from the periphery of the spool member, the attachment member adapted to attach a portion of a carpet to the spool member, and an actuating member adapted to rotate the spool member about its axis, so that, as the actuating member rotates the spool member over the carpet to which the spool member is attached, the carpet is pulled from the floor and wound on the spool member. Typically, the attachment member is a row of tooth members extending from the periphery of the spool member.

A further aspect of the invention provides a method of removing carpet adhered to a floor, involving the steps of attaching an edge of the carpet to a cylindrical spool member, and rolling the spool member over an upper surface of the carpet.

BRIEF DESCRIPTION OF THE DRAWINGS

The manner in which these objectives and other desirable characteristics can be obtained is explained in the following description and attached drawings in which.

Figure 1:
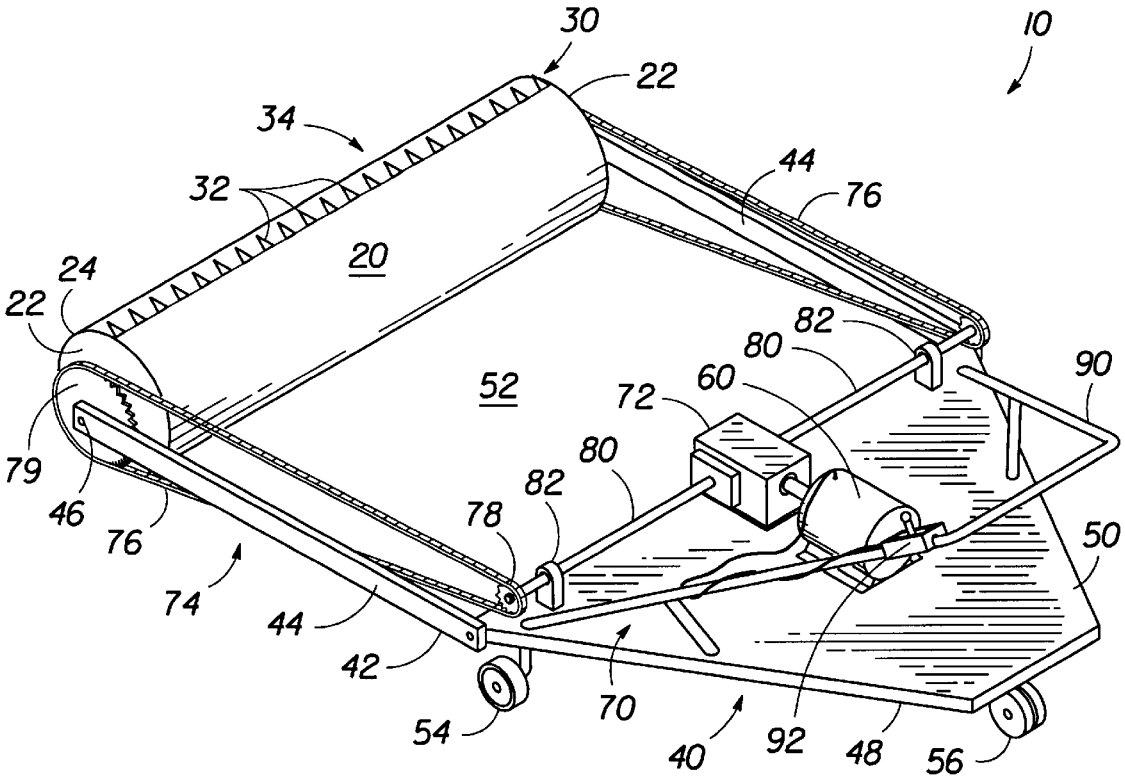
FIG. 1 is a perspective view of the carpet removal apparatus.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention generally provides a carpet removal apparatus 10 for removing carpet 4 adhered to a floor 8 by an adhesive that uses a cylindrical spool member 20 to which a free edge of the carpet 4 is attached. The spool member 20 is then rotated about its axis over the upper surface 6 of the carpet 4 winding the carpet 4 onto the spool member 20 and tearing the carpet 4 from the floor 8.

Carpet 4 is often adhered to the floor 8 using an adhesive, particularly in commercial and other large buildings. The edges 5 of the carpet 4 extend to the walls to provide a complete cover for the floor 8. Over time, the carpet 4 may become worn or outdated and therefore require replacement. To complete removal of the carpet 4, the adhesive bond between the carpet 4 and the floor 8 must be broken. Typically, this is done by tearing the carpet 4 away from the floor 8 and the present invention facilitates this removal.

FIG. 1 is a perspective view of the preferred embodiment of the carpet removal apparatus 10. The preferred embodiment includes a cylindrical spool member 20, means for attaching an edge 5 of the carpet 4 to the spool member 20, and means for rotating the spool member 20 over the upper surface 6 of the carpet 4 so that as the spool rotates, the carpet 4 is torn from the floor 8 and wound onto the spool member 20.

The spool member 20 is cylindrical and elongated having opposing ends 22 and defining an axis about which the spool rotates. The spool may be formed of a standard polyvinyl chloride (PVC) pipe and typically has a diameter of about sixteen to twenty inches, although virtually any diameter will suffice. With a smaller diameter spool member 20, more carpet 4 may be rolled on the spool member 20. However, the diameter of the spool member 20 cannot be so small that it is too difficult to rotate or so small that the carpet 4 cannot effectively roll onto the spool member 20.

Preferably, the attachment member 30 for attaching the edge 5 of the carpet 4 to the spool member 20 is a plurality of tooth members 32 that extend outwardly from the periphery 24, outer surface, of the spool member 20. As shown in the figure, the tooth members 32 are aligned laterally across the spool member 20 in a row to form a row of tooth members 34. The tooth members 32 may extend radially from the spool member 20 or at some other angle to the outer surface of the spool member 20. The outermost end of the tooth members 32 are sharp and pointed so that they may penetrate the carpet 4 and hold the edge 5 of the carpet 4 to the spool member 20. The length of the tooth members 32 is sufficiently long that they may hold at least one layer of the carpet 4 thereto, but not so long that the tooth members 32 substantially penetrate more than two layers of carpet 4 and thereby interfere with the rolling action of the spool member 20. Providing the row of tooth members 34 provides attachment of the carpet 4 to the spool member 20 across the full width of the spool member 20. Once the spool member 20 completes a full revolution, the carpet 4 will creates layers over previously wound carpet 4 and, thereby, holds itself to the spool member 20. However, the attachment member 30 helps to keep the spool member 20 from merely rotating within the rolled carpet 4, but instead forces the carpet 4 to roll with the spool member 20. The spool member 20 may include a plurality of rows of tooth members extending therefrom to enhance the gripping and attachment of the carpet 4 to the spool member 20.

Figure 2:
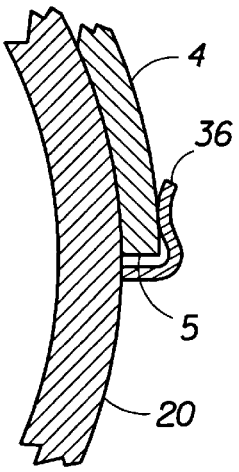
FIG. 2 is a partial side elevational cross sectional view of the spool member showing use of a clip as the attachment member.
Figure 3:
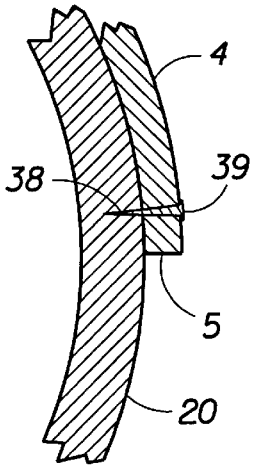
FIG. 3 is a partial side elevational cross sectional view of the spool member showing use of a screw and a tapped hole as the attachment member.

Other devices may be used to attach the edge 5, or portion, of the carpet 4 to the spool member 20. For example, the carpet 4 could be taped to the spool member 20 using a relatively strong tape. Likewise, as shown in FIG. 2, clips 36 attached to the spool member 20 may be used to clamp the carpet 4 to the spool member 20. Another alternative embodiment, shown in FIG. 3, includes tapped holes 38 in the outer surface of the spool member 20 through which sharpened screws 39 could be cooperatively inserted after penetrating a portion of the carpet 4. The screws 39 then hold the carpet 4 to the spool member 20. Many other attachment means are possible and anticipated.

In the preferred embodiment, the means for rotating the spool member 20 is an actuating member 40. Preferably, the actuating member 40 includes a frame 42 rotatably attached to the opposing ends 22 of the spool member 20 so that the spool member 20 may rotate relative to the frame 42. Power from a motor 60 attached to the frame 42 is transmitted to the spool member 20 by means of a power transmission member 70 so that the motor 60 rotates the spool member 20. The frame 42 is formed of a pair of side members 44, each rotatably attached to an opposing end of the spool member 20 at the forward end of the side member 44 by, for example, a pin 46 or shaft. A support plate 48 attached to the rearward ends of the side members 44 connects the side members 44 and provides a flat upper surface 50 to which the motor 60 and power transmission components may be attached. The side members 44 and the support member are substantially rigid providing a rigid frame 42 to which the components of the carpet removal apparatus 10 may be attached. The side rails are sufficiently long that they space the support member from the spool member 20 and thereby define an open space 52 therebetween that is sufficiently large that the carpet 4 may be rolled on the spool member 20 without contacting the support member. A set of wheels 54 support the frame 42 and allow the frame 42 to move freely with the movement of the spool member 20. Typically, a pair of support wheels 54 are positioned on each side of the support member near the front of the support member and a rear caster 56 is positioned centrally near the back of the support member. The rear caster 56 is rotatably attached to the support member so that it is free to spin and easily change directions as well as roll and, thus, facilitates steering of the carpet removal apparatus 10.

The motor 60 is attached to the upper surface 50 of the support member by conventional means such as bolting. The motor 60 may be an electric motor, a gasoline-powered motor, a hydraulic motor, or may have any other power source to drive the motor. Preferably, the motor 60 will produce about ¾ horsepower of power and includes a standard mounting for attachment to the power transmission member 70. Preferably, the motor 60 operates in forward and reverse and includes an idle.

The power transmission member 70 shown in FIG. 1 is a speed reducer and includes a right angle speed reducer 72 and a speed reducing belt system 74 made up of a belt 74 and a set of pulleys. The belt system 74 may be replaced with a speed reducing chain system formed of a chain and a set of sprockets. The right angle speed reducer 72 is attached to and in communication with the motor 60. The motor 60 drives the speed reducer which transmits the power therethrough and reduces the output rotational speed of the motor 60 by, for example, about sixty to one. An example of a right angle speed reducer 72 capable of providing the required speed reduction and power transmission is a WINSMITH right angle speed reducer 72 model number 926MWN. The right angle speed reducer 72 includes a double shaft 80 extending from each side of the right angle speed reducer 72. The shafts 80 extend to the sides of the carpet removal apparatus 10 and are supported at their ends distal the speed reducer by bearing blocks 82. The shaft 80 is sized to transmit at least the power output of the right angle speed reducer 72. Attached to the end of each of the shafts 80 is the small, pinion pulley 78 (or sprocket) of the belt system 74 (or chain system). For ease of description, the present application refers primarily to a belt system 74 although a chain system is also useful. The small pulley 78 spins with the shaft 80 and transmits the power of the shaft 80 from the small pulley 78 to a large pulley 79 attached to the end of the spool member 20. A large pulley 79 is attached to each end of the spool member 20. The large pulleys 79 are fixedly attached to the spool member 20 so that rotation of the large pulleys 79 produces a rotation of the spool member 20. Typically, the speed reduction provided by the belt system 74 or chain system is between about four to one and ten to one. Accordingly, the power transmission member 70 transmits the power of the motor 60 through the right angle speed reducer 72, through the shaft 80 to the small pulley 78, and through the belt 74 to the large pulley 79 and the spool member 20 causing the rotation of the spool member 20.

A handle 90 attached to the frame 42 extends upwardly to a position that is convenient for a user of the carpet removal apparatus 10. The handle 90 is relatively rigid and allows the user to steer the carpet removal apparatus 10.

Attached to the upper end of the handle 90 is a control member 92 in communication with the motor 60 that is adapted to control the speed and direction of the motor 60. The control member 92 is conveniently located for access by the user to allow the user to control the motion of the carpet removal apparatus 10. The control member 92 allows the user to advance the carpet removal apparatus 10 in forward or reverse and allows the user to place the carpet removal apparatus 10 in idle. The control member 92 may be a lever, a set of buttons, or any other standard control apparatus.

Figure 4:
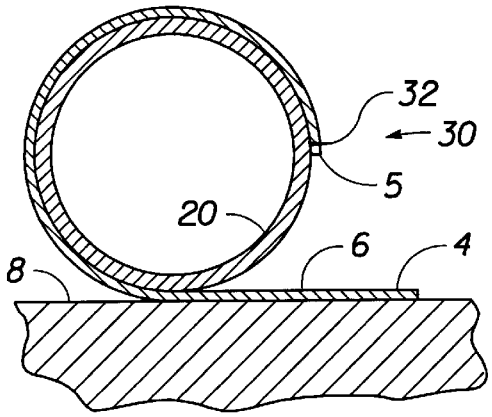
FIG. 4 is a partial side elevational cross sectional view of the spool member showing the carpet attached to the spool member.

In operation, the carpet removal apparatus 10 is placed on the upper surface 6 of the carpet 4 and an edge 5 of the carpet 4 is attached to the spool member 20. A portion of the carpet 4 may need to be initially cut to the width of the spool member 20 to facilitate rolling of the carpet 4 onto the spool member 20. However, typically only an initial portion of the carpet 4 need be cut for, as the carpet removal apparatus 10 winds the carpet 4 onto the spool member 20, the carpet 4 will naturally tear to the proper width. FIG. 4 is a partial side elevational cross sectional view of the spool member 20 to which the carpet 4 is attached using a row of tooth members 34. The spool member 20 has not yet completed a full revolution, therefore, the tooth members 32 hold the carpet 4 to the spool member 20.

Figure 5:
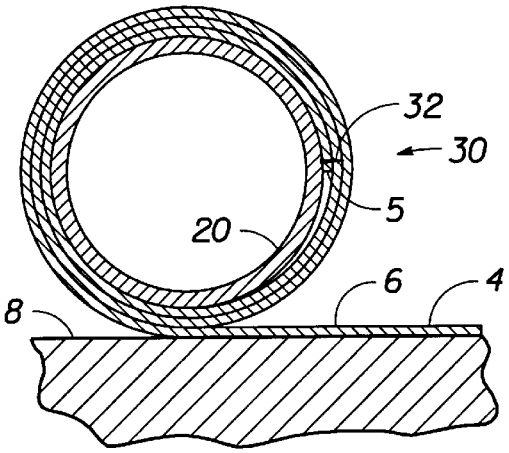
FIG. 5 is a partial side elevational cross sectional view of the spool member showing the carpet attached to the spool member and wound on the spool member several rotations.

Once the carpet 4 is attached to the spool member 20, the motor 60 is activated and the user positions the control member 92 to move the carpet removal apparatus 10 in the forward direction. The motor 60 produces a rotation which is transmitted through the power transmission means, wherein the speed is reduced and the power increased, to the spool member 20 causing a forward rotation of the spool member 20. As the spool member 20 rotates over the upper surface 6 of the carpet 4, the carpet 4 is wound onto the spool member 20 as shown n FIG. 5. The winding of the carpet 4 onto the spool member 20 rips the carpet 4 from the floor 8. The frame 42 provides a cantilevered weight that helps keep the wheels 54 on the ground and the frame 42 near the ground facilitating winding of the carpet 4 onto the spool member 20. A user may step on the back of the support member of the frame 42 to enhance this cantilevered weight, if needed, depending upon the amount of torque required to rip the carpet 4 from the floor 8.

Once the spool member 20 is full or a barrier, such as a wall, is reached, the carpet 4 is removed from the spool member 20 and the process is repeated. To remove the carpet 4, the carpet removal apparatus 10 may be placed in reverse wherein the motor 60 turns in the reverse direction causing the spool member 20 to rotate in the reverse direction and, thereby, unwinding the carpet 4 from the spool member 20. Alternatively, the carpet removal apparatus 10 may be placed in idle, wherein the spool member 20 is free to rotate freely relative to the frame 42. When in idle, the carpet 4 can be easily pulled from the spool member 20. In a preferred alternative embodiment, the spool member 20 is easily removable from the frame 42. In this way, a spool member 20 having a full winding of carpet 4 thereon may be removed from the carpet removal apparatus 10 and another, empty spool member 20 placed thereon. The removable spool members 20 allows more efficient use of the machine as one spool member 20 may be unwound while the carpet removal apparatus 10 continues to operate using another spool member 20.

Figure 6:
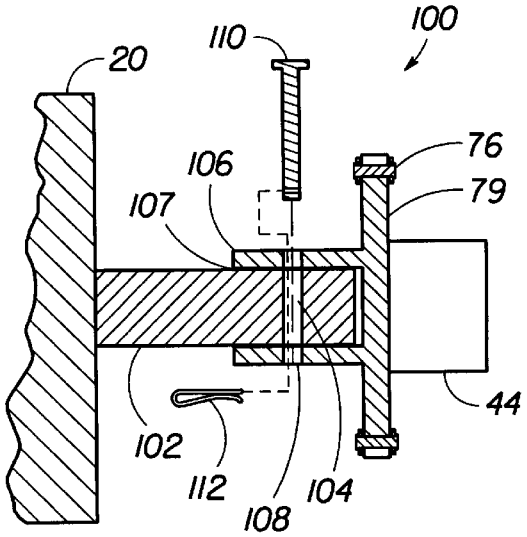
FIG. 6 is a partial side elevational cross sectional view of the release mechanism.

FIG. 6 is a partial side elevational cross sectional view of an embodiment of the carpet removal apparatus 10 showing the release mechanism 100. When incorporating the release mechanism 100 shown, the side members 44 of the frame 42 are hinged at their rearward ends to allow the front ends of the side members 44 to move laterally away from the spool member 20. The preferred release mechanism 100 shown includes a shaft 102 attached to the spool member 20 extending axially from the ends 22 of the spool member 20. The shaft 102 is fixedly attached to the spool member 20 so that rotation of the shaft 102 causes a rotation of the spool member 20. The shaft 102 defines a pin hole that extends radially therethrough proximal the end of the shaft 102. A sleeve 106 is fixedly attached to the pulley 79 (or sprocket) so that rotation of the pulley 79 causes a rotation of the sleeve 106. The sleeve 106 extends axially from the inside surface of the pulley 79 toward the spool member 20. The sleeve 106 defines an axial cavity 107 sized and adapted to receive the shaft 102 therein. Also, the sleeve 106 defines a radial sleeve hole 108 therein that is positioned and adapted for alignment with the shaft hole 104 when the shaft 102 is positioned in the sleeve 106. The shaft hole 104 and the sleeve hole 108 have substantially the same diameter. A connecting pin 110 is sized and adapted to fit through the aligned sleeve hole 108 and shaft hole 104 and prevent their relative rotation so that the sleeve 106 and shaft 102 rotate together when the connecting pin 110 is positioned therein.

The diameter of the connecting pin 110 is sufficient to transmit at least the maximum torque transmitted to the shaft 102. A cotter pin 112 may be placed through a hole defined in the end of the connecting pin 110 to hold the connecting pin 110 in place. Many alternative designs for a release mechanism 100 are possible and anticipated.

Figure 7:
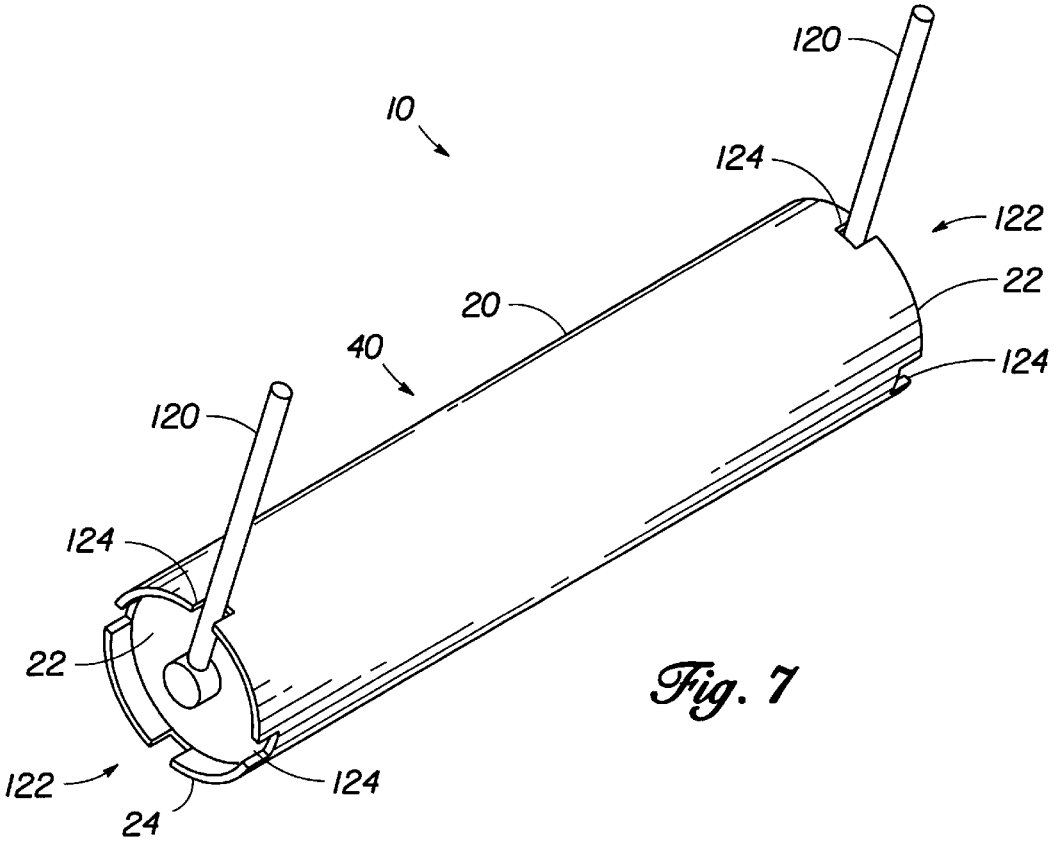
FIG. 7 is a perspective view of an alternative, manual embodiment of the carpet removal apparatus.

FIG. 7 is a perspective view of an alterative, manual embodiment for the carpet removal apparatus 10. In the alternative embodiment shown, the actuating member 40 is a pair of rotating handles 120 attached to the spool member 20. Although many alternatives of the manual embodiment are possible, the preferred embodiment includes a pair of rotating handles 120, one attached to each end of the spool member 20. Each rotating handle 120 is rotatably connected to the end of the spool member 20 near its axis. The rotating handles 120 are free to rotate about the axis of the spool member 20 as well as about an axis perpendicular to the axis of the spool member 20. The periphery 24 of the spool member 20 defines at least one, but preferably a plurality, of bearing members 122 against which an intermediate portion of the rotating handle 120 may abut, or bear. In the preferred embodiment, shown in FIG. 7, the spool member 20 defines a plurality of slots 124 spaced equally about its periphery 24 in the ends 22 of the spool member 20. These slots 124 act as the bearing members 122. The rotating handle 120 may be positioned with an intermediate portion of the rotating handle 120 in one of the slots 124. The user, or users, may then pull on the apogee ends of the handles to rotate the spool member 20. Once rotated to a position where the slot is no longer useful, the handle may then be positioned in another slot and the process repeated. Typically, two users are required to operate the carpet removal apparatus 10 shown in FIG. 7.

While the foregoing is directed to the preferred embodiment of the present invention, other and further embodiments of the invention may be devised without departing from the basic scope thereof, and the scope thereof is determined by the claims which follow.

I claim:

1. A carpet removal apparatus for removing a carpet adhered to a floor from the floor, the carpet having edges and an upper surface, comprising;

a cylindrical spool member having an axis and opposing ends;

an attachment member attached to the cylindrical spool member, the attachment member adapted to attach an edge of the carpet to the spool member;

a frame rotatable attached to the opposing ends of the spool member;

a support plate of the frame spaced from the spool;

a motor attached to and supported by the support plate;

a power transmission member attached to the motor and the spool member, the power transmission member adapted to transmit power from the motor to the spool member and to selectively rotate the spool member;

so that, as the spool member rotates, the carpet is torn from the floor and wound onto the spool member;

the spool member and the support plate defining a space therebetween that is sufficient to accommodate a plurality of layers of carpet therebetween; and the frame adapted to provide a cantilevered weight capability sufficient to prevent vertical movement of the frame relative to the floor.

2. The apparatus of claim 1, wherein the spool member is elongated.

3. The apparatus of claim 1, wherein the attachment member comprises:

a plurality of tooth members extending outwardly from the spool member; and the plurality of tooth members laterally aligned between the ends of the spool member to form a row of tooth members.

4. The apparatus of claim 3, wherein the plurality of tooth members extend radially from the spool member.

5. The apparatus of claim 3, further comprising a plurality of rows of tooth members.

6. The apparatus of claim 1, wherein the motor is an electric motor.

7. The apparatus of claim 1, wherein the motor is a gasoline powered motor.

8. The apparatus of claim 1, wherein the power transmission member is a speed reducer.

9. The apparatus of claim 1, wherein the spool member is removable from the frame.

10. The apparatus of claim 1, further comprising a release mechanism adapted to selectively release the spool from and attach the spool to the frame.

11. A method of removing carpet adhered to a floor, comprising the steps of:

attaching an edge of the carpet to a cylindrical spool member;

providing a frame rotatably attached to the spool member, the frame having a support plate spaced from the spool member and defining a space therebetween that is sufficient to accommodate a plurality of layers of carpet;

providing a cantilevered weight to a rear of the frame sufficient to prevent rotation of the frame about the spool; and rolling the spool member over an upper surface of the carpet using a motor attached to the frame to actuate the rolling motion.

* * * * *